US009889464B1

(12) United States Patent
Winne

(10) Patent No.: US 9,889,464 B1
(45) Date of Patent: Feb. 13, 2018

(54) APPARATUS FOR FINISHING DRYWALL WITHOUT SANDING

(71) Applicant: Clark T. Winne, Fritz Creek, AK (US)

(72) Inventor: Clark T. Winne, Fritz Creek, AK (US)

( * ) Notice: Subject to any disclaimer, the term of this patent is extended or adjusted under 35 U.S.C. 154(b) by 714 days.

(21) Appl. No.: 13/716,021

(22) Filed: Dec. 14, 2012

Related U.S. Application Data

(60) Provisional application No. 61/570,497, filed on Dec. 14, 2011.

(51) Int. Cl.

| | |
|---|---|
| ***E04F 21/08*** | (2006.01) |
| ***A46B 11/06*** | (2006.01) |
| ***B05C 17/00*** | (2006.01) |
| ***B24D 15/04*** | (2006.01) |
| ***B24B 7/18*** | (2006.01) |
| ***B05C 17/01*** | (2006.01) |
| ***E04F 21/12*** | (2006.01) |
| ***B25G 3/38*** | (2006.01) |
| ***A47L 13/22*** | (2006.01) |
| ***B24B 23/00*** | (2006.01) |

(52) U.S. Cl.
CPC ..... *B05C 17/00* (2013.01); *A47L 13/22* (2013.01); *B24B 23/00* (2013.01)

(58) Field of Classification Search
CPC ..... F04B 9/14; F04B 23/02–23/14; F04D 13/068; B24D 15/00
USPC ..... 417/234; 23/2, 14; 401/5, 48, 143, 401/136–140, 289; 451/523, 353; 239/373, 154; 222/176
See application file for complete search history.

(56) References Cited

U.S. PATENT DOCUMENTS

| | | | | | |
|---|---|---|---|---|---|
| 927,872 | A | * | 7/1909 | Price | A46B 11/063 401/131 |
| 1,894,420 | A | * | 1/1933 | Ranish | A47L 13/30 15/144.1 |
| 2,764,774 | A | * | 10/1956 | Belsky | A47L 13/257 15/144.2 |
| 4,152,084 | A | * | 5/1979 | Melton | A47L 13/22 15/229.4 |
| 4,184,291 | A | | 1/1980 | Marton | |
| 4,197,338 | A | | 4/1980 | Perna | |
| 4,263,677 | A | | 4/1981 | Menser | |
| 4,320,601 | A | | 3/1982 | Haney | |
| 4,484,419 | A | | 11/1984 | Freerks | |
| 4,660,329 | A | | 4/1987 | Hutchins | |
| 4,671,020 | A | | 6/1987 | Hutchins | |
| 4,806,037 | A | * | 2/1989 | Berglund | A47L 13/30 401/140 |
| 4,829,719 | A | | 5/1989 | Braselton | |
| 4,922,665 | A | | 5/1990 | Wanatowicz | |
| 4,955,748 | A | * | 9/1990 | Krumholz | A47L 13/22 401/140 |
| 4,971,471 | A | * | 11/1990 | Sloan | A47L 13/20 15/210.1 |

(Continued)

*Primary Examiner* — Allana Lewin Bidder
*Assistant Examiner* — Thomas M Abebe
(74) *Attorney, Agent, or Firm* — Suiter Swantz pc llo

(57) ABSTRACT

A drywall finishing apparatus includes a water reservoir connected to a water distribution element. The water distribution element applies water to a finishing pad. The finishing pad is designed to allow water to flow through and reconstitute already applied drywall mud. The reconstituted drywall mud can then be smoothed out with the finishing pad. The finishing pad creates a hydroplaning effect to glide over the drywall mud.

18 Claims, 11 Drawing Sheets

(56) References Cited

U.S. PATENT DOCUMENTS 5,022,190 A 6/1991 Hutchins
5,193,313 A 3/1993 Sanchez et al.
5,245,797 A 9/1993 Milkie
5,428,865 A 7/1995 Yarbrough
5,651,728 A 7/1997 Stanzione
5,752,661 A * 5/1998 Lewis ..... B05B 9/0861 222/175
5,885,145 A 3/1999 O'Mara
6,083,307 A 7/2000 Dular
6,109,548 A * 8/2000 George ..... B05B 9/0805 222/333
6,325,708 B1 * 12/2001 Miles ..... B24D 15/023 451/344
6,394,683 B1 * 5/2002 Pao ..... A47L 13/22 401/137
6,641,469 B2 11/2003 Deshler
6,854,912 B2 * 2/2005 Dyer ..... A47L 13/22 401/131
7,033,259 B1 4/2006 Seasholtz et al.
7,048,458 B2 * 5/2006 Hall ..... A47L 13/22 222/518
7,182,681 B2 2/2007 Kirschhoffer et al.
7,249,996 B1 * 7/2007 Volyar ..... B24B 7/184 451/354
7,275,981 B1 * 10/2007 Hurt ..... B24D 15/023 451/524
D556,534 S 12/2007 Henke et al.
D564,325 S 3/2008 Henke et al.
7,384,328 B2 * 6/2008 Panfili ..... B24B 23/00 451/344
7,416,477 B2 8/2008 Henke et al.
7,473,165 B1 1/2009 Berryhill
7,488,242 B2 * 2/2009 Gringer ..... B24D 15/04 451/344
7,621,686 B2 * 11/2009 Fernschild ..... A46B 11/063 401/137
7,625,264 B1 * 12/2009 Gordon ..... B24B 7/184 451/294
7,670,073 B2 * 3/2010 Fernschild et al. ..... 401/48
7,670,210 B2 * 3/2010 Annis ..... B24D 15/023 451/490
7,854,396 B2 * 12/2010 Wu ..... A01C 23/008 239/152
7,927,192 B2 * 4/2011 Annis ..... B24B 7/184 15/143.1
D680,844 S * 4/2013 Thompson ..... D8/90
8,469,775 B2 * 6/2013 Dow ..... B24B 7/184 451/344
8,591,292 B2 * 11/2013 Roscher ..... B24B 7/18 451/353
D697,955 S * 1/2014 Arvinte ..... D15/126
8,628,381 B2 * 1/2014 Arvinte ..... B24B 7/184 451/354
8,747,006 B2 * 6/2014 Payne ..... E04F 21/08 401/137
8,826,961 B2 * 9/2014 Castagnetta ..... B25G 3/38 156/574
8,851,773 B2 * 10/2014 Gill ..... E04F 21/165 15/235.4
2001/0003563 A1 * 6/2001 Schauer ..... B05C 17/002 401/5
2002/0083679 A1 7/2002 Hanner
2004/0161283 A1 * 8/2004 Lithgow ..... E04F 21/12 401/48
2005/0013652 A1 * 1/2005 Corbosiero ..... B08B 3/026 401/289
2005/0019085 A1 * 1/2005 Fernschild ..... A46B 11/063 401/48
2005/0100386 A1 * 5/2005 Murray ..... B05C 17/005 401/5
2005/0232684 A1 * 10/2005 Giacomo ..... B05C 17/002 401/136
2005/0271457 A1 * 12/2005 Suda ..... A47L 13/22 401/139
2005/0287937 A1 * 12/2005 Florio ..... B24B 23/00 451/354
2006/0073778 A1 * 4/2006 Phillips ..... B24B 7/184 451/354
2006/0205331 A1 * 9/2006 Gringer ..... B24D 15/04 451/532
2007/0077114 A1 * 4/2007 Mondloch ..... E04F 21/08 401/48
2008/0031677 A1 * 2/2008 Hitchner ..... A47L 13/312 401/139
2009/0000051 A1 * 1/2009 Rosenzweig ..... A47L 13/22 15/228
2009/0097902 A1 * 4/2009 Lemmon ..... A47L 11/26 401/140
2009/0252546 A1 * 10/2009 Kaleta ..... A47L 13/22 401/139
2010/0009609 A1 * 1/2010 Dow ..... B24B 7/184 451/522
2010/0086342 A1 * 4/2010 Blom ..... A47L 13/22 401/139
2010/0096475 A1 * 4/2010 Strauss ..... A01M 7/0046 239/373
2011/0171889 A1 7/2011 Arvinte et al.
2013/0071170 A1 * 3/2013 Mehus ..... F16L 37/32 401/139
2013/0216294 A1 * 8/2013 MacMillan ..... B05C 17/01 401/143

* cited by examiner

APPARATUS FOR FINISHING DRYWALL WITHOUT SANDING

PRIORITY

The present application claims the benefit under 35 U.S.C. § 119(e) of U.S. Provisional Application Ser. No. 61/570,497, filed Dec. 14, 2011, which is incorporated herein by reference.

FIELD OF THE INVENTION

The present invention is directed generally toward the field of gypsum drywall used in construction, and particularly to an apparatus for finishing drywall without at least some reduction in the need for sanding.

BACKGROUND OF THE INVENTION

Typical drywall (sometimes referred to as sheetrock) installation requires three basic steps: installing (or hanging), taping and finishing. Installing is the process of fastening dimensionally sized boards of gypsum drywall to framing members of a wall or ceiling. Taping is the process of bridging and filling gaps between drywall boards. Finishing is the end process of covering the tape and fully filling and smoothing the gaps between the drywall boards, as well as filling and smoothing over screw or nail holes and other imperfections in the drywall surface. The goal in finishing is a substantially flat surface between boards such that, when painted, joints between two drywall boards are substantially undetectable. This process usually requires at least two applications of joint compound, (sometimes referred to as mud) on top of tape, with a broad flexible spreading tool. The mud is spread over seams, holes and imperfections. After each layer of mud is allowed to dry completely, the area must be sanded to reveal voids, remove tool marks, ridges of mud and other imperfections.

Construction workers who sand drywall at the finishing stage of installation are exposed to high concentrations of dusts containing talc, calcite, mica, gypsum and in some cases silica. Some of these materials have been associated with varying degrees of acute and chronic eye, nose, throat and respiratory tract irritations. When silica is present, workers also face the risk of silicosis and lung cancer. Any reduction in airborne dust is beneficial to every person involved in the construction process. Eliminating dust at the drywall finishing stage means fewer workers and residents exposed to hazardous dust.

Workers who are comfortable are more productive, and a cleaner work environment results in a superior drywall finish. Reducing or eliminating dust is particularly important in buildings such as hospitals, banks and office complexes that often require remodeling as fine airborne dusts can wreak havoc with sensitive and costly machines. Fine dust particles are spread far from the source through air exchange systems in buildings, necessarily exposing such machines to potential damage.

Conventional abrasive sanding deposits large amounts of dust on walls and ceilings, and also abrades the drywall paper, leaving visible fuzz. Painters are obliged to meticulously back-roll a primer coat in order to "lay down" this dust and fuzz. Back-rolling is both time-consuming and laborious, meaning longer exposure to paint fumes and more expense for builders. Even with back-rolling, the different textures of smooth drywall, fuzz and dust under the paint can show through. Also, conventional sanding leaves scratch marks in the finished surface.

A National Institute of Occupational Safety and Health (NIOSH) Health Hazard Evaluation found that drywall finishers, when sanding, were exposed to as much as ten times the permissible limit of total dust set by the Occupational Safety and Health Administration (OSHA). The limit for respirable dust (very small particles that can migrate deep into a person's lungs) was also exceeded.

Drywall finishers are advised to wear safety glasses, but safety glasses are impractical because the lenses become obscured with dust and fogged from the drywall finisher's breath escaping from the face mask.

Existing systems for reducing dust require the drywall finisher to be hooked up to an industrial vacuum cleaner. Such systems are expensive, cumbersome and noisy. Drywall finishers must drag the vacuum apparatus around, ensuring the hose does not kink or tangle, and ensuring that the apparatus does not damage finished corners. Vacuum systems also require electrical power, which may not be conveniently available during construction. Vacuum hoses and electrical cords pose a serious hazard to drywall finishers on stilts, and may be unusable on scaffolding. Drywall finishers must also endure the inevitable noise produced by such vacuum systems. Furthermore, vacuum based systems still emit dust through the exhaust, and vacuum exhaust tends to blow settled dust back into the air.

In another NIOSH study, five drywall compound manufacturers' material safety data sheets warned workers to avoid generating dust and to use respiratory protection when sanding. "Respiratory protection" generally means a flimsy mask that does not always fit properly, and is hot and uncomfortable. The report also advised wet sanding whenever possible. Wet sanding involves using a special sanding sponge. The sanding sponge requires frequent rinsing and wringing out, making the process more labor-intensive than dry sanding. A bucket of water must be carried with the worker at all times, and the water must be changed once it becomes too murky. Wet sanding is generally avoided in actual work practice because it is more labor intensive than dry sanding.

Consequently, it would be advantageous if an apparatus existed that is suitable for dust free finishing of drywall.

SUMMARY OF THE INVENTION

Accordingly, the present invention is directed to a novel apparatus for dust free finishing of drywall.

At least one embodiment of the present invention is a drywall finishing apparatus having a water reservoir and a water distribution element to apply water to a finishing pad. The finishing pad is designed to allow water to flow through and reconstitute already applied drywall mud. The reconstituted drywall mud can then be smoothed out with the finishing pad. The finishing pad creates a hydroplaning effect to glide over the drywall mud.

In another embodiment of the present invention, the water distribution element and finishing pad are mounted to an extension pole.

In another embodiment of the present invention, the water reservoir includes a pump to pressurize the reservoir and force water to the water distribution element at a desirable flow rate.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the subject matter disclosed, which is illustrated in the accompanying drawings. The scope of the invention is limited only by the claims; numerous alternatives, modifications and equivalents are encompassed. For the purpose of clarity, technical material that is known in the technical fields related to the embodiments has not been described in detail to avoid unnecessarily obscuring the description.

Figure 1:
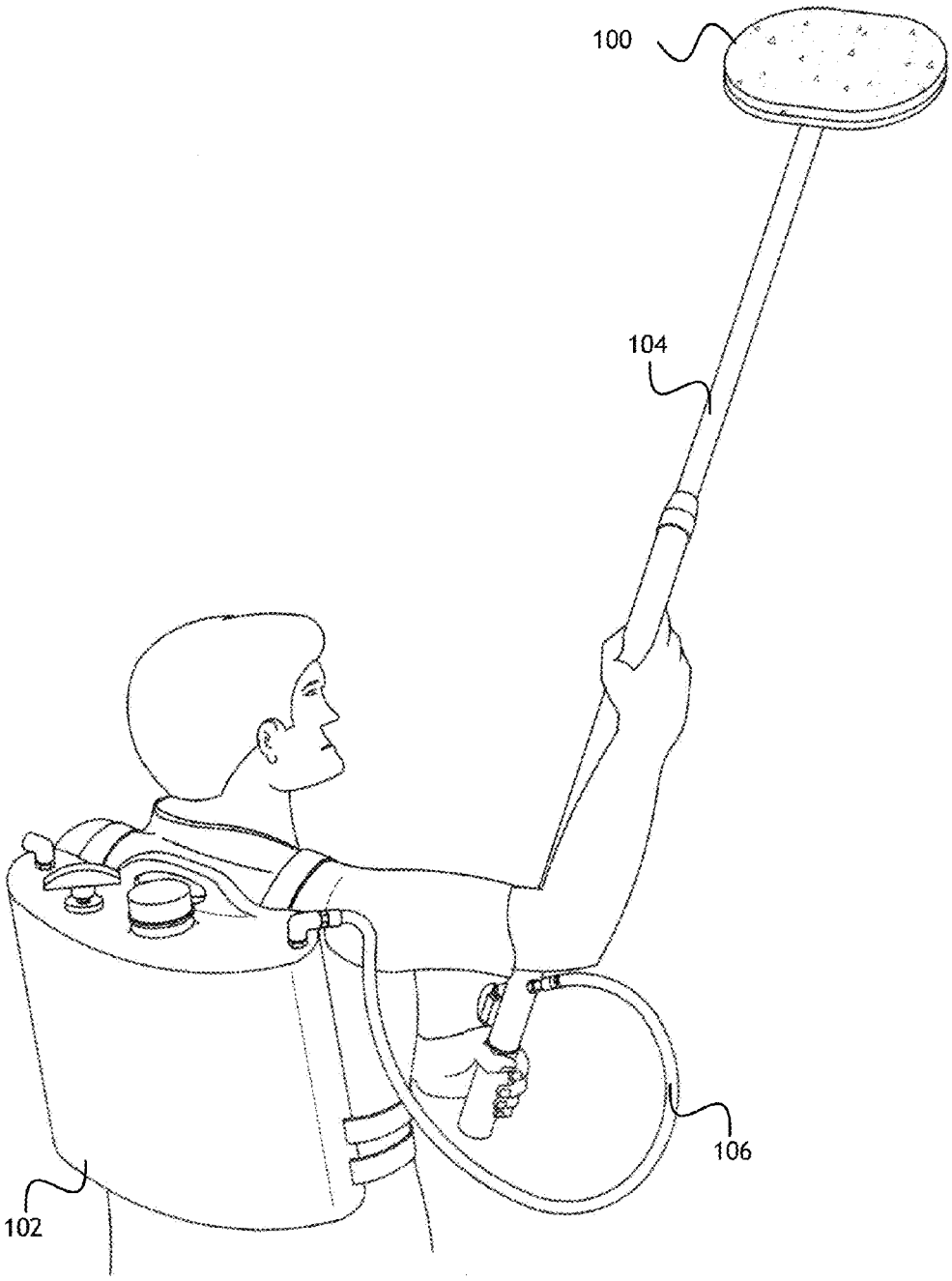
FIG. 1 shows an environmental view of one embodiment of the present invention including a water reservoir connected to an extension pole and finishing head.

Referring to FIG. 1, an environmental view of one embodiment of the present invention including a water reservoir connected to an extension pole and finishing head is shown. In at least one embodiment, a drywall finishing apparatus includes a finishing head 100 to distribute a quantity of water onto applied drywall mud. The quantity of water is sufficient to reconstitute a layer of the drywall mud without compromising the mechanical function of the mud. The finishing head 100 may include a finishing pad to apply the quantity of water and to provide a contact surface to smooth and redistribute the reconstituted mud. In at least one embodiment of the present invention, a contact surface of approximately 19.5 square inches is desirable.

The finishing head 100 may be connected to a water reservoir 102 through a water delivery hose 106. The water delivery hose 106 may be largely contained within the extension pole 104, or may connect to other water control components contained within the extension pole 104.

Figure 2:
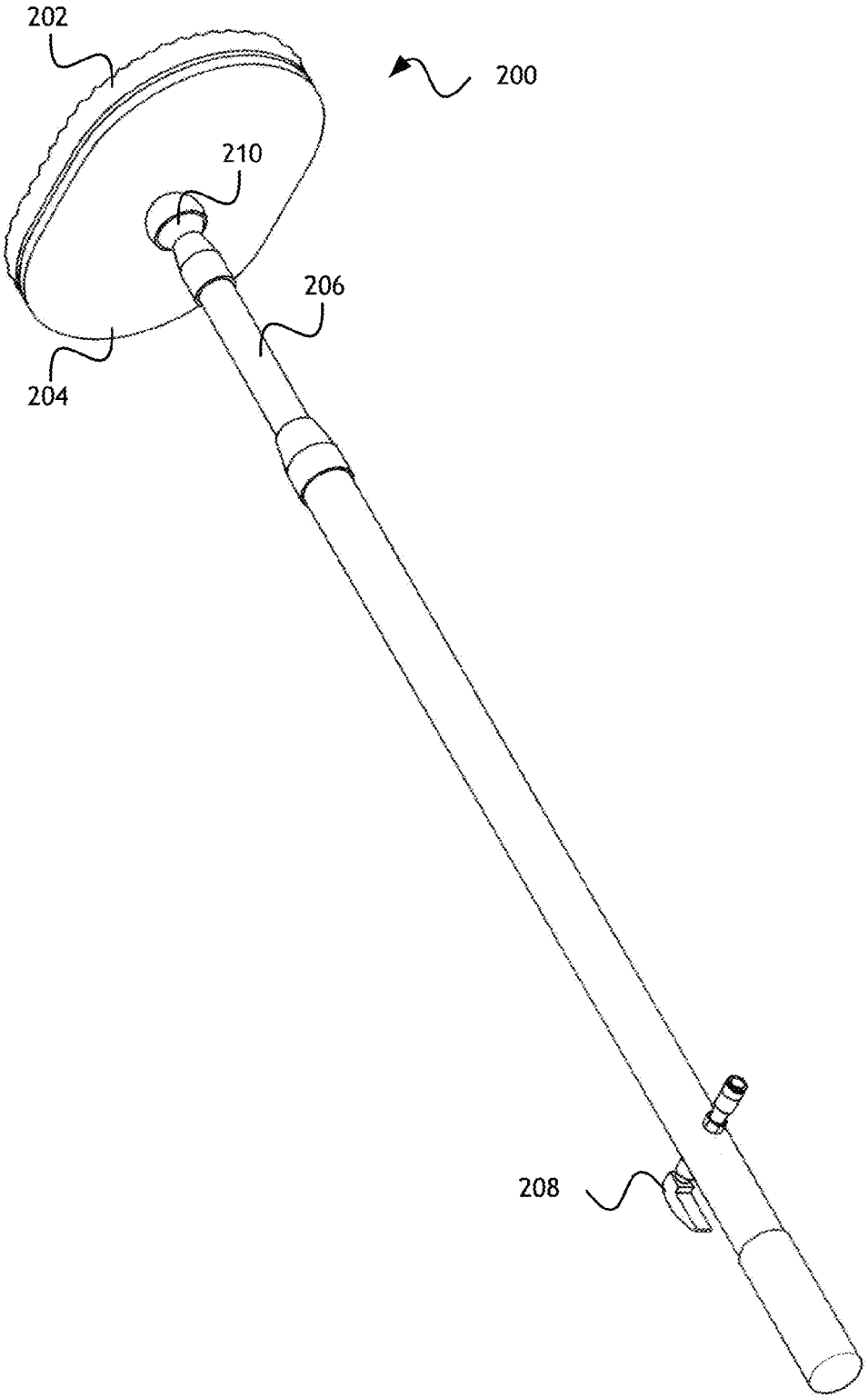
FIG. 2 shows a perspective view of one embodiment of the present invention including an extension pole and finishing head.

Referring to FIG. 2, a perspective view of one embodiment of the present invention including an extension pole and finishing head is shown. In at least one embodiment, a drywall finishing apparatus includes a finishing head 200 to distribute a quantity of water onto applied drywall mud. The quantity of water is sufficient to reconstitute a layer of the drywall mud without compromising the mechanical function of the mud.

The finishing head 200 may include a water distribution element 204 and a finishing pad 202 connected to the water distribution element 204. The water distribution element 204 moistens the finishing pad 202 sufficiently to reconstitute drywall mud when the finishing pad 202 is placed in contact with drywall mud during drywall finishing. The finishing pad 202 applies water to the drywall mud, reconstituting the drywall mud sufficiently to allow the finishing pad 202 to smooth the surface of the mud. Because the water is flowing through the finishing pad 202, there is no need for rinsing.

In at least one embodiment of the present invention, the finishing head 200 is adapted to remove residual mud from bullnose (or round) corners, metal corners, and chamfered corners. The finishing head 200 may be shaped to accommodate such corners and reconstitute excess mud applied to such corners. Excess mud is then smoothed out or removed. Alternatively, a flat finishing head 200 may be manipulated around a corner to reconstitute and smooth a layer of drywall mud. At least one embodiment of the present invention may include a sprayer connected to a water reservoir. The sprayer may be used to directly wet portions of drywall mud at a corner. A drywall finisher may then use a finishing head according to the present invention to smooth such reconstituted mud.

The finishing head 200 may be connected to an extension pole 206 through a joint 210 such as a universal joint. The joint 210 allows the water distribution element 204 to pivot so that the finishing pad 202 may remain in contact with drywall during finishing. The extension pole 206 may be extendable, with two or more coaxial sections that may be telescopically extended and locked into position. The extension pole 206 allows a drywall finisher to finish sections of drywall mud that may otherwise require stilts or scaffolding. Alternatively, the extension pole 206 may be used in conjunction with stilts and scaffolding to reach applied drywall mud that is otherwise unreachable.

The drywall finishing apparatus may also include a switching mechanism 208 to control the flow of water to the finishing head 200. The switching mechanism 208 may be embedded in the extension pole 206 at a location easily accessible to a drywall finisher during use.

Figure 3:
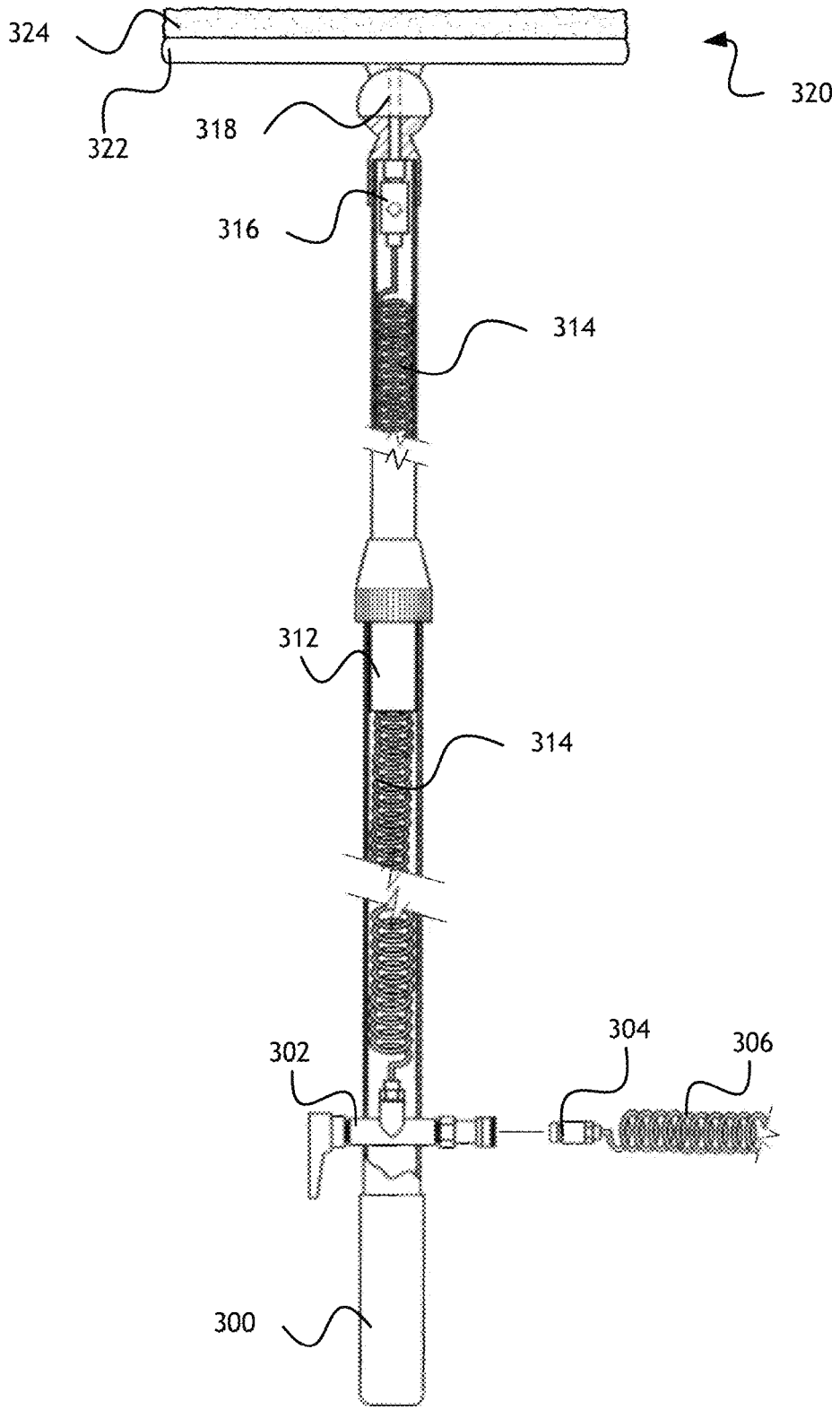
FIG. 3 shows a cross-sectional view of one embodiment of the present invention including an extension pole and valves.

Referring to FIG. 3, a cross-sectional view of one embodiment of the present invention including an extension pole and valves is shown. In at least one embodiment of the present invention, a drywall finishing apparatus includes a finishing head 320. The finishing head 320 may include a water distribution element 322. The water distribution element 322 may receive water from a water reservoir and distribute the water substantially uniformly over a finishing pad 324. The finishing pad 324 may include perforations to allow a desirable water flow rate onto already applied drywall mud. The water distribution element 322 may include a manifold to distribute water and a distribution plate to substantially uniformly support a finishing pad 324 while supplying water to the finishing pad 324 through water distribution openings.

The finishing head 320 may be connected to a swiveling mechanism 318 such as a universal joint to allow the finishing head 320 to rotate or pivot or both. The finishing head 320 and corresponding finishing pad 324 should maintain even contact with the drywall surface during drywall finishing. Unintentional interruption of contact between the finishing pad 324 and the drywall surface may adversely affect the drywall finish, although a person skilled in the art may appreciate that a drywall finishing apparatus according to the present invention may be used to correct irregularities caused by loss of contact.

The swiveling mechanism 318 connects the finishing head 320 to an extension pole 312 and handle 300. The extension pole 312 may include two or more telescopically extendable sections. The extension pole 312 may also contain water control components to deliver water to the water distribution element 322.

Water control components may include a check valve 316. The check valve 316 prevents any back-flow of water when the water is not pressurized. Where the extension pole 312 is telescopically extendable, the check valve maybe connected to a coiling hose 314. The coiling hose 314 maintains fluid connectivity when the extension pole 312 is telescopically extended, and also allows the extension pole 312 to be retracted. The coiling hose 314 connects the check valve 316 to a switch mechanism 302. The switch mechanism 302 may include a valve to allow water to flow from a water reservoir to the finishing head 320. Such valve may include a ball valve, needle valve or other suitable flow control mechanism. Furthermore, the valve may be calibrated to allow a desirable flow rate. The switch mechanism 302 may also activate a pumping mechanism to pressurize the water reservoir, such as an air pump. Alternatively the switch mechanism 302 may activate a water pump such as a piston pump to deliver water to the finishing head 320. The switch mechanism 302 may be adjustable such that a drywall finisher may adjust the flow rate of water within a desirable range. The switch mechanism 302 may include a quick release connection point to engage a quick release 304 on a water delivery hose 306. The water delivery hose 306 may further include a quick release (not shown) to connect the water delivery hose 306 to a corresponding quick release connection point on a water reservoir. Quick release 304 elements connecting the water delivery hose 306 to the switching mechanism 302 and a water reservoir allow for greater versatility. For example, a drywall finisher operating on stilts may disconnect the water delivery hose 306 from the switching mechanism 302 to more easily manipulate a water reservoir onto the drywall finisher's back, and then reconnect the water delivery hose 306 to the switching mechanism 302. Alternatively, the water delivery hose 306 may be disconnected from a water reservoir so that the water reservoir may be more easily refilled.

Figure 4:
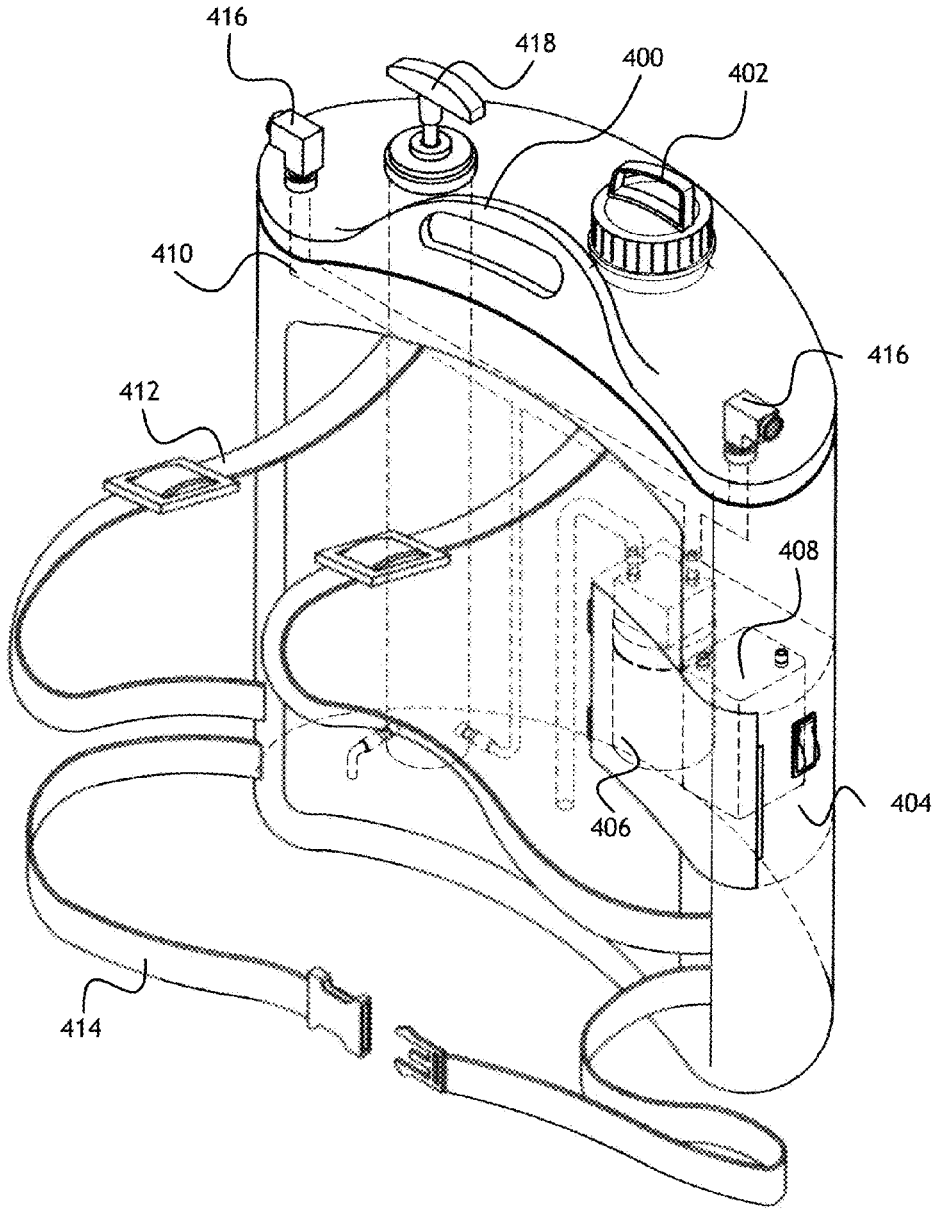
FIG. 4 shows a perspective view of a water reservoir useful in embodiments of the present invention.

Referring to FIG. 4, a perspective view of a water reservoir useful in embodiments of the present invention is shown. In at least one embodiment of the present invention, a drywall finishing apparatus includes a water reservoir. The water reservoir delivers water to a finishing head designed to reconstitute a layer of drywall mud so that the mud can be smoothed without sanding. The water reservoir may include a handle 400 for easy transport and a filler cap 402 to access the water reservoir and add water.

The water reservoir may be wearable. For example, the water reservoir may include shoulder straps 412 and a belt 414 to secure the water reservoir to a drywall finisher's back. In such case, the water reservoir should contain a quantity of water that is safe to transport on the drywall finishers back. In at least one embodiment, the water reservoir may have a capacity of approximately three gallons. A wearable water reservoir should be small enough to allow the drywall finisher access to enclosed spaces such as closets, and should be sufficiently water tight to prevent leakage when the drywall finisher bends over.

In at least one embodiment, a pump chamber 404 houses a pump 406 and battery pack 408. The pump chamber 404 may be partially surrounded by water in the water reservoir to muffle any noise from the pump 406. The battery pack 408 powers the pump 406 to deliver water, under pressure, through internal plumbing 410 to at least one reservoir valve 416.

The pump 406 may deliver water at a rate of between 0.4 and 0.75 pints per minute. In testing, a professional drywall finisher was able to finish 57.6 linear feet of mudded seams, and used approximate one pint of water to finish 144 linear feet of mudded seams resulting in a water usage of approximately 0.4 pints per minute. Water delivery of less than 0.4 pints per minute may be insufficient to adequately reconstitute drywall mud. Conversely, water delivery of more than 0.75 pints per minute may saturate a finishing pad to such an extent that the finishing pad reconstitutes more than the desired layer of drywall mud, or water sloshes out of a finishing head uncontrollably.

Alternatively, a water reservoir may be pressurized by pumping air into the water reservoir through a hand pump 418. In any case, additional water control components may be necessary to restrict the flow of water to a desirable rate.

Water may be delivered to a finishing head at pressure by other means. For example, an electrically powered piston pump may pump water to the finishing head. Such embodiment may require additional electrical control components such as power and flow control. Such additional electrical control components may be housed in an extension pole.

Figure 5:
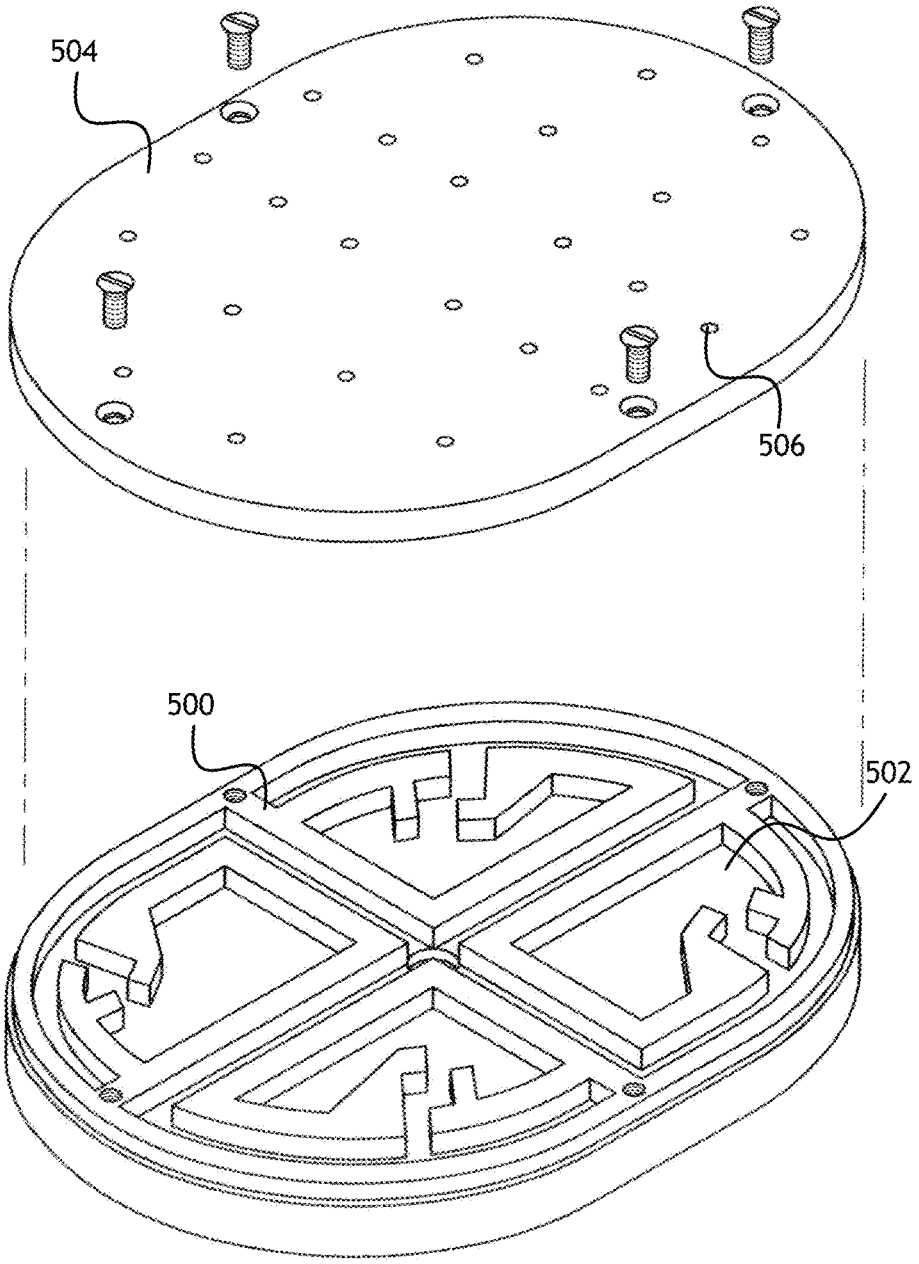
FIG. 5 shows a view of a water distribution manifold, useful in embodiments of the present invention.

Referring to FIG. 5, a view of a water distribution manifold, useful in embodiments of the present invention is shown. In at least one embodiment of the present invention, a drywall finishing apparatus includes a water distribution element with a distribution manifold to deliver water to a finishing pad. The manifold may include baffles 500 defining one or more water distribution channels 502. Baffles 500 prevent water from pooling at one edge of the water distribution manifold due to gravity. Water may be distributed from the water distribution channels 502 through a water distribution plate 504. The water distribution plate 504 may include one or more water distribution openings 506 to evenly distribute water to a finishing pad and to further control the flow rate of water. A finishing pad may be placed over the water distribution manifold; as water fills the water distribution channels 502 and flows through the water distribution openings 506, the finishing pad may allow water to pass through onto a portion of applied drywall mud. The water reconstitutes a layer of the drywall mud, allowing the reconstituted layer to be smoothed and redistributed.

Figure 6:
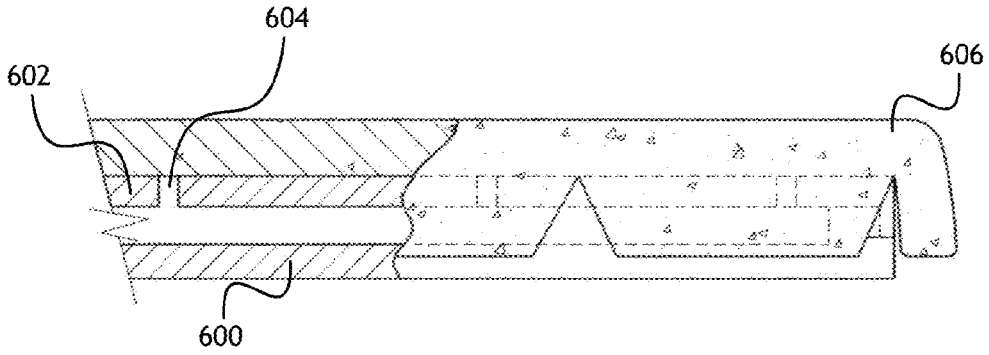
FIG. 6 shows a close-up, cross-sectional view of a finishing head with a water distribution manifold and finishing pad.

Referring to FIG. 6, a close-up, cross-sectional view of a finishing head with a water distribution manifold and finishing pad is shown. A water distribution manifold useful in embodiments of the present invention includes a manifold 600 to receive water from a water reservoir at a desired flow rate. Water may be contained in the manifold 600 by a water distribution plate 602 having one or more water distribution openings 604. The water distribution openings 604 allow water to flow, at the desired flow rate, to a finishing pad 606 attached to the water distribution manifold.

Figure 7A:
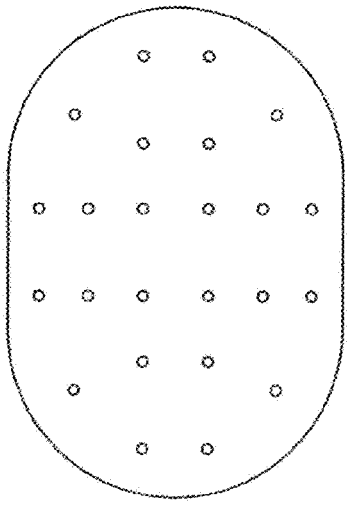
FIG. 7A shows an alternative shape of a water distribution element.
Figure 7B:
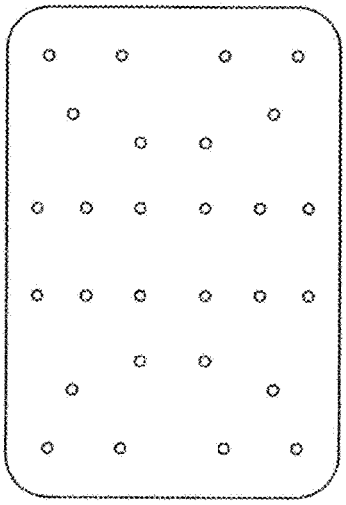
FIG. 7B shows an alternative shape of a water distribution element.
Figure 7C:
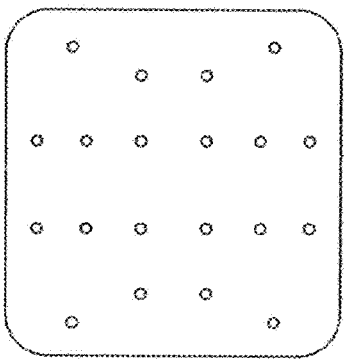
FIG. 7C shows an alternative shape of a water distribution element.
Figure 7D:
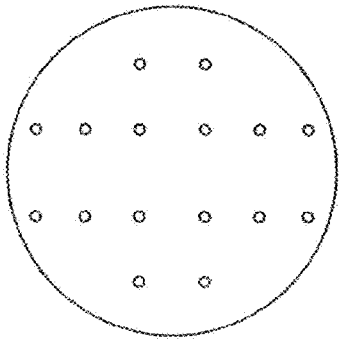
FIG. 7D shows an alternative shape of a water distribution element.
Figure 7E:
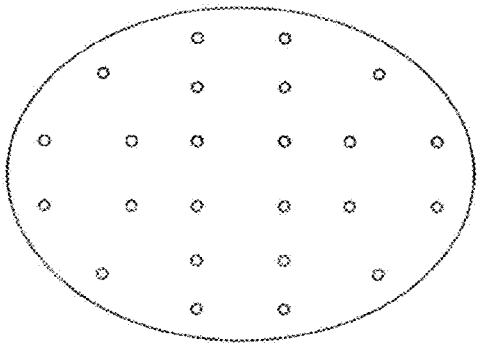
FIG. 7E shows an alternative shape of a water distribution element.

Referring to FIGS. 7A-7E, alternative shapes of water distribution elements are shown. While some of the foregoing figures illustrate rectangular water distribution elements and finishing pads, round or elliptical water distribution elements and finishing pads are also contemplated. Round elements may prevent unintentional flipping and gouging during use. For example, FIG. 7A shows a rectangular water distribution element with rounded corners; FIG. 7B shows a rectangular water distribution element; FIG. 7C shows a square water distribution element; FIG. 7D shows a round water distribution element; and FIG. 7E shows an elliptical water distribution element.

Embodiments of the present invention obviate the need for respiratory masks and protective eyewear by replacing the process of sanding with a dust-free finishing methodology. An apparatus according to the present invention can be used comfortably and safely on stilts and on scaffolds.

Vacuum systems currently available claim eighty percent to ninety-five percent reduction in dust. Embodiments of the present invention are one hundred percent dust-free because no sanding is required; therefore no dust is ever generated. Also, because no dust is generated, there is no time-consuming and ineffectual clean-up of dust from floors, ledges and sills. In addition, embodiments of the present invention may include a sprayer to directly wet patches of drywall mud that inadvertently dry on floors or sills. The sprayer wets and reconstitutes the patches of drywall mud which may then be wiped off instead of chiseled away. Additionally, during the finishing process, mud is frequently deposited on vinyl window edges. Previously, dried mud would have to be chiseled and pried off of the edge. Utilizing embodiments of the present invention, a sprayer may be used to wet mud deposited on window edges. The deposited mud may then be peeled away easily with a drywall blade or other flat instrument. No chiseling is required, and consequently no dust is generated. Peeling off the deposited mud leaves a clean, smooth drywall edge and provides follow-up painters with a dust free surface to which they may affix masking tape prior to spraying.

Embodiments of the present invention leave a superior finish as compared to conventional drywall sanding, with none of the scratch marks, roughed paper or residual dust that can mar even the best finished drywall. Furthermore, embodiments of the present invention eliminate the need for back-rolling during painting. Embodiments of the present invention may also allow for improved finishing time. Professional drywall finishers may effectively finish more than fifty-five linear feet of mudded seams per minute.

Another advantage of embodiments of the present invention over conventional sanding is that the mud does not need to be completely dry before use.

Figure 8:
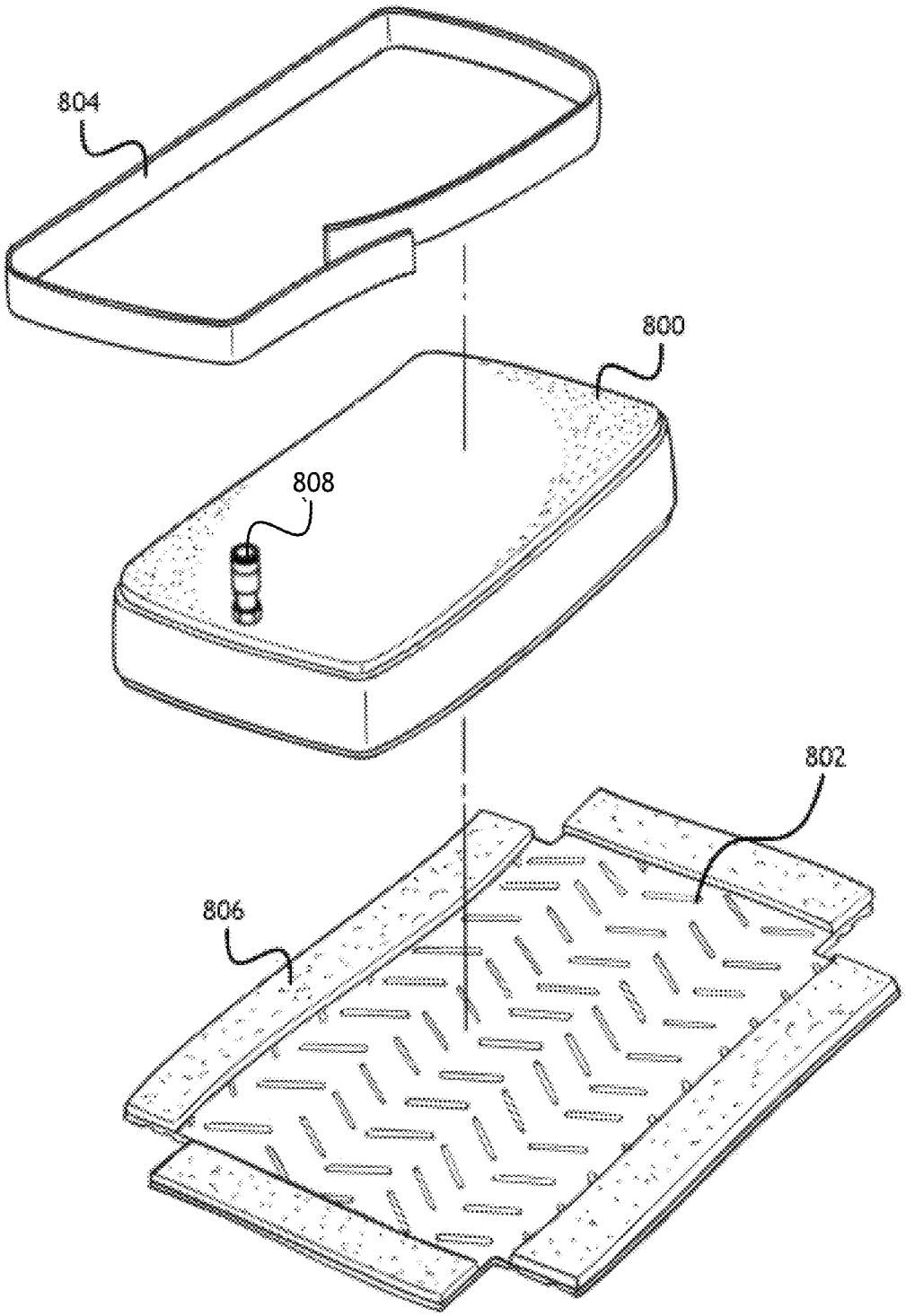
FIG. 8 shows an exploded, perspective view of one embodiment of a drywall finishing apparatus according embodiments of the present invention.

Referring to FIG. 8, an exploded, perspective view of another embodiment of a drywall finishing apparatus is shown. In at least one embodiment of the present invention, a drywall finishing apparatus includes a water distribution element 800. The water distribution element 800 receives water from a reservoir through a quick release 808 and distributes the water evenly to a finishing pad 802. In at least one embodiment, the finishing pad 802 may include small depressions in the contact surface. Such small depressions contribute to a hydroplaning effect. The finishing pad 802 may also include slightly raised ridges. During drywall finishing, such ridges lay the reconstituted mud flat, filling cracks and gaps. Alternatively, the finishing pad 802 may be substantially smooth or slightly abrasive. A drywall finishing apparatus according to the present invention does not produce any dust because no sanding ever occurs.

The finishing pad 802 may be removable and replaceable. The finishing pad 802 may include nylon mesh to enhance structural integrity. In at least one embodiment of the present invention, a contact surface of approximately 17.5 square inches is desirable.

The drywall finisher moves the finishing pad 802 along the edges previously requiring sanding, maintaining a steady flow of water through the water distribution element 800. The mud is reconstituted by water flowing onto the surface through the finishing pad 802. Such embodiment may be operable to remove excess mud from outside corners.

In at least one embodiment of the present invention, the water distribution element 800 and finishing pad 802 may be adapted to remove residual mud from bullnose (or round) corners, metal corners, and chamfered corners. The water distribution element 800 may be shaped to accommodate such corners and reconstitute excess mud applied to such corners. Excess mud is then smoothed out or removed. Alternatively, a flat water distribution element 800 may be manipulated around a corner to reconstitute and smooth a layer of drywall mud. At least one embodiment of the present invention may include a sprayer connected to a water reservoir. The sprayer may be used to directly wet portions of drywall mud at a corner. A drywall finisher may then use a finishing head according to the present invention to smooth such reconstituted mud.

Because of the lubricating properties of water, the tool effectively is hydroplaning over the surfaces, and does not require the drywall finisher to push up onto the surfaces as he would with a conventional sander. It is therefore much less tiring for the drywall finisher.

In addition, embodiments of the present invention leave visible wet portions, providing a visible record of where the drywall finisher has been and what still requires his attention. Therefore no areas are inadvertently left unfinished.

In at least one embodiment of the present invention, the water distribution element is a manifold, though other mechanisms for delivery water from a reservoir to a finishing pad 802 are envisioned. In at least one embodiment, the finishing pad 802 is a sponge.

In at least one embodiment of the present invention, the finishing pad 802 includes gripping strips 806 to enhance the connection between the finishing pad 802 and the water distribution element 800. Gripping strips 806 may comprise an active fastener such as hook-and-loop fabric, or a passive, friction based element. In at least one embodiment of the present invention, the finishing pad 802 may be secured to the water distribution element 800 with a retention band 804. The retention band 804 may be an elastic band, a strap secured with hook-and-loop fabric, metal fastening band, or any other similar securing mechanism.

Figure 9:
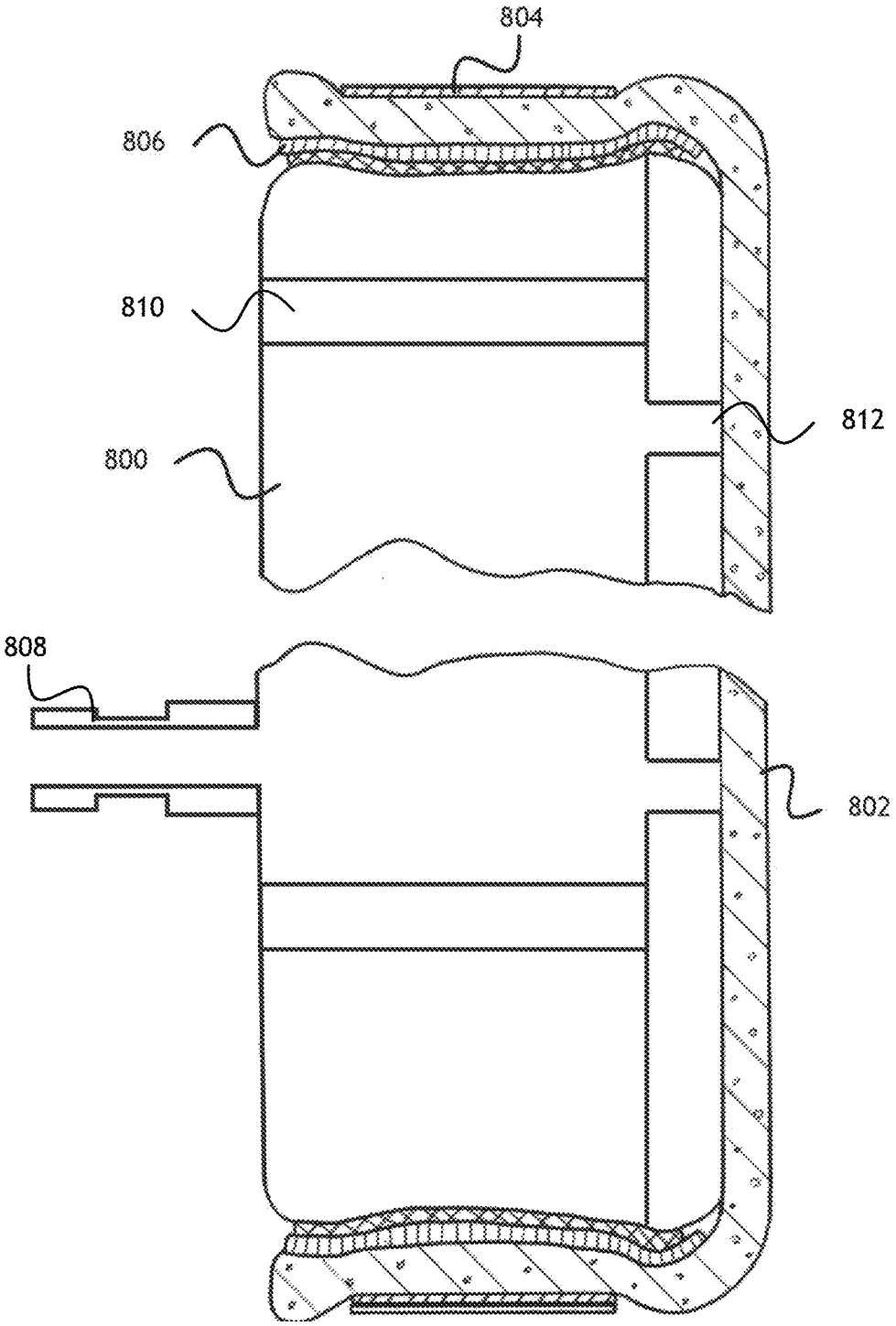
FIG. 9 shows a cross-sectional view of one embodiment of the present invention.

Referring to FIG. 9, a cross-sectional view of one embodiment of the present invention is shown. In at least one embodiment of the present invention, a drywall finishing apparatus includes finishing pad 802 wrapped around a water distribution element 800. The finishing pad 802 and water distribution element 800 remain in contact at least at a portion of the finishing pad 802 corresponding to a contact surface so that the water distribution element 800 may supply water to the finishing pad 802 contact surface.

The finishing pad 802 may be held in place by a retention band 804. The retention band 804 holds portions of the finishing pad 802 to peripheral surfaces of the water distribution element 800. In at least one embodiment, the finishing pad 802 may include gripping strips 806 interposed between the finishing pad 802 and the peripheral surfaces of the water distribution element 800. The gripping strips 806 may be affixed to the finishing pad 802. Gripping strips 806 may enhance the securing effect of the retention band 804.

In at least one embodiment of the present invention, the water distribution element 800 may receive water from a reservoir through a quick release 808. The water distribution element 800 may by a manifold with internal spaces defined by baffles 810. The water distribution element 800 may be in contact with a portion of the finishing pad 802 corresponding to the contact surface. Water from the water distribution element 800 may flow through water distribution openings 812 into the finishing pad 802. The water distribution element may receive a substantially continuous flow of water to maintain the moistened state of the contact surface. Such embodiment may include a flow control mechanism on the water distribution element 800 or on a water reservoir connected to the water distribution element 800 through a water delivery hose. The flow control mechanism may include a switch mechanism to control the flow rate of water to the water distribution mechanism 800.

Figure 10:
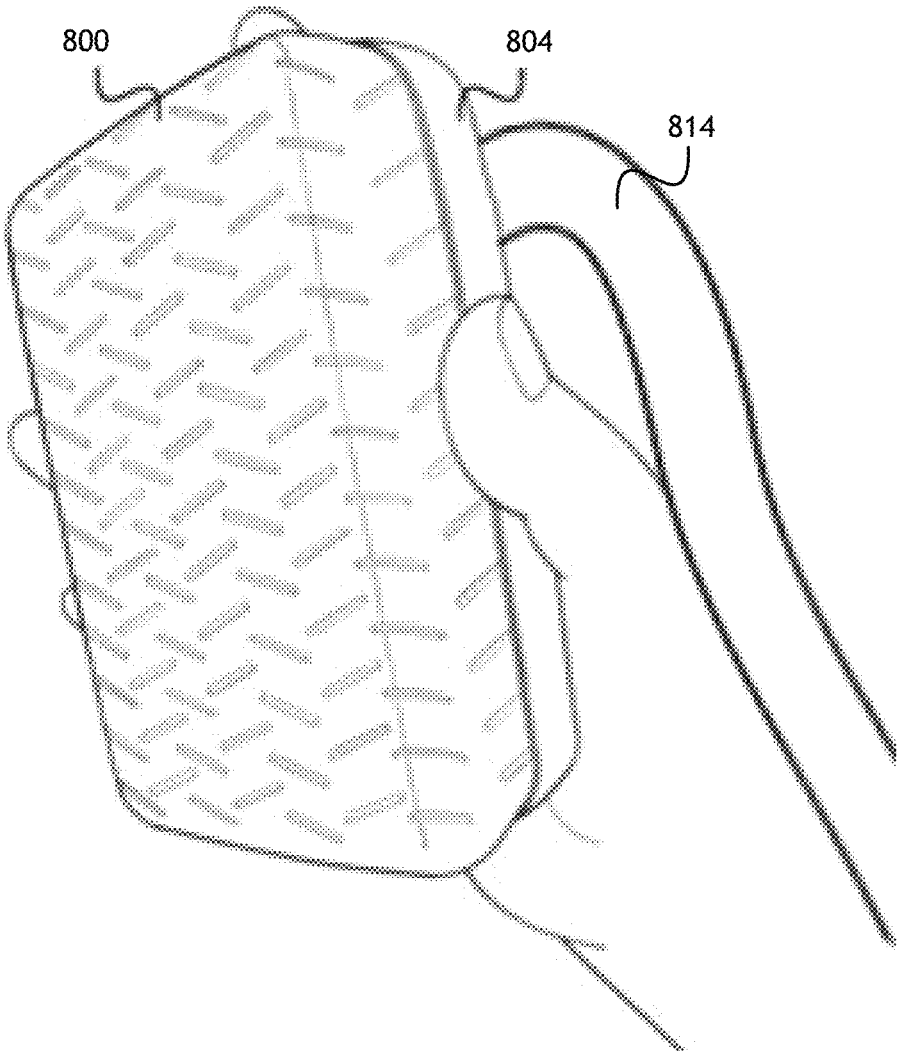
FIG. 10 shows a perspective view of a hand-held embodiment of the present invention such as described in FIG. 8 and FIG. 9.

Referring to FIG. 10, a perspective view of a hand-held embodiment of the present invention such as described in FIG. 8 and FIG. 9 is shown. The embodiment may include a distribution element 800 covered by a finishing pad. The finishing pad may be secured to the distribution element 800 by a retention band 804. A quick release (such as the quick release 808 in FIG. 8 and FIG. 9) may connect to a delivery hose 814. The delivery hose 814 supplies water from a water reservoir.

Figure 11:
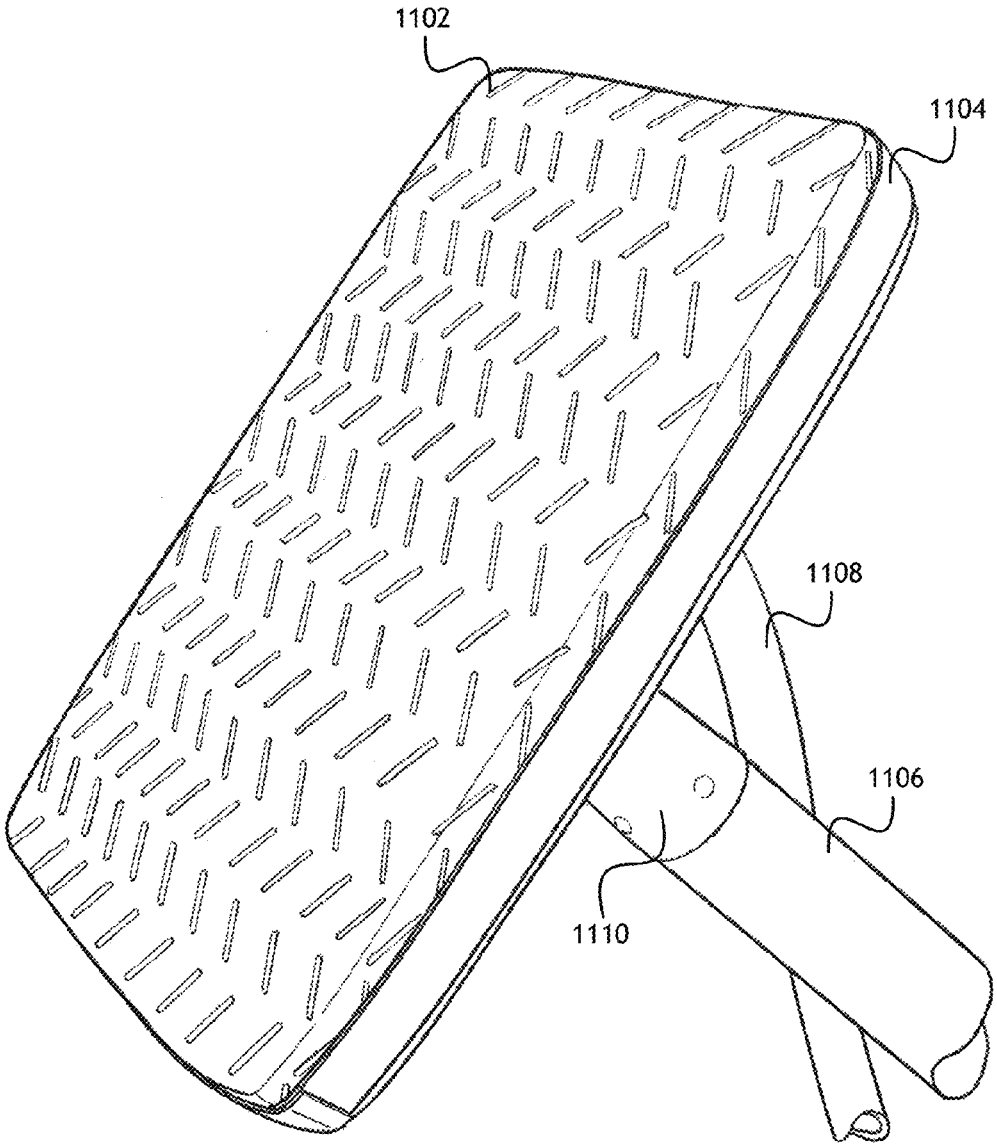
FIG. 11 shows a perspective, close-up view of a finishing head of another embodiment of the present invention including an extension pole.

Referring to FIG. 11, a perspective, close-up view of a finishing head of another embodiment of the present invention including an extension pole is shown. In at least one embodiment of the present invention, a drywall finishing apparatus includes a finishing pad 1102 with a contact surface for moistening already applied drywall mud. The finishing pad may be secured to a water distribution element with a retention band 1104 securing portions of the finishing pad 1102 to peripheral surfaces of the water distribution element. The water distribution element may be secured to an extension pole 1106 through a universal joint 1110. The extension pole may allow a drywall finisher to reach areas of applied drywall mud that are otherwise inaccessible. The extension pole 1106 may also allow a drywall finisher to finish areas that would otherwise require stilts or scaffolding.

In at least one embodiment of the present invention, the water distribution element may receive a substantially continuous flow of water through a water delivery hose 1108. The water delivery hose 1108 may connect the water distribution element to a water reservoir. In at least one embodiment, the water distribution element may include a manifold to distribute and continuously supply water to the finishing pad 1102.

It is believed that the present invention and many of its attendant advantages will be understood by the foregoing description of embodiments of the present invention, and it will be apparent that various changes may be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A drywall finishing apparatus comprising:

a water reservoir comprising:

a battery pack;

a pump powered by the battery pack; and at least one reservoir valve coupled to the battery pack-powered pump;

a water distribution assembly comprising:

a manifold with a plurality of baffles and one or more distribution channels, wherein the plurality of baffles include one or more curved baffles, wherein the one or more distribution channels include one or more curved distribution channels aligned with the one or more curved baffles;

a distribution plate restricting water flow to a flow rate of at least 0.4 and not substantially more than 0.75 pints per minute over a linear foot of sandable mudded drywall seam, such that no more than a pint of water is used to reconstitute 144 linear feet of sandable mudded drywall seam into a paintable surface; and a finishing pad with a contact surface of at least 17.5 and not substantially more than 19.5 square inches, wherein the battery pack-powered pump drives water at the flow rate of at least 0.4 and not substantially more than 0.75 pints per minute through the contact surface; and an extension pole having a first end and a second end, the extension pole comprising:

a handhold at the first end;

a swivel mechanism coupled to the water distribution assembly at the second end;

a switch mechanism at the first end, the switch mechanism coupled to the water reservoir; and a check valve contained within the extension pole at the second end, the check valve coupled to the switch mechanism, the check valve additionally coupled to the manifold of the water distribution assembly.

2. The drywall finishing apparatus of claim 1, wherein the water reservoir further comprises:

shoulder straps; and a belt, wherein the shoulder straps and the belt are coupled to a concave surface of the water reservoir.

3. The drywall finishing apparatus of claim 1, wherein the water reservoir further comprises:

a hand pump.

4. The drywall finishing apparatus of claim 3, wherein at least one of the battery pack-powered pump and the hand pump draws air into the water reservoir.

5. The drywall finishing apparatus of claim 1, wherein at least one of the battery pack-powered pump and the hand pump pumps water out of the water reservoir.

6. The drywall finishing apparatus of claim 1, wherein the finishing head conforms to a corner.

7. The drywall finishing apparatus of claim 1, wherein the water reservoir has a capacity of no more than three gallons.

8. The drywall finishing apparatus of claim 1, wherein the battery pack-powered pump is disposed in a pump chamber within the water reservoir such that the battery pack-powered pump is surrounded by water to muffle noise generated by the battery pack-powered pump.

9. The drywall finishing apparatus of claim 1, further comprising:

a sprayer coupled to the water reservoir.

10. The drywall finishing apparatus of claim 1, wherein a nylon mesh is integrated into the finishing pad.

11. The drywall finishing apparatus of claim 1, further comprising a water delivery hose, wherein the water delivery hose is coupled to the switch mechanism via a first quick release assembly, wherein the water delivery hose is coupled to the water reservoir via a second quick release assembly.

12. The drywall finishing apparatus of claim 1, wherein water flows through the contact surface of the finishing pad at a surface flow rate of at least 0.022 pints per minute per square inch and not substantially more than 0.038 pints per minute per square inch.

13. An apparatus for applying water to mudded seams comprising:

a water reservoir comprising:

a battery pack;

a pump powered by the battery pack; and at least one reservoir valve coupled to the battery pack-powered pump;

a water distribution assembly comprising:

a manifold with a plurality of baffles and one or more distribution channels, wherein the plurality of baffles include one or more curved baffles, wherein the one or more distribution channels include one or more curved distribution channels aligned with the one or more curved baffles;

a distribution plate restricting water flow to a flow rate of at least 0.4 and not substantially more than 0.75 pints per minute over a linear foot of sandable mudded drywall seam, such that no more than a pint of water is used to reconstitute 144 linear feet of sandable mudded drywall seam into a paintable surface; and a finishing pad with a contact surface of at least 17.5 and not substantially more than 19.5 square inches, wherein the battery pack-powered pump drives water at the flow rate of at least 0.4 and not substantially more than 0.75 pints per minute through the contact surface; and a water flow control assembly comprising:

a switch mechanism coupled to the water reservoir; and a check valve, the check valve coupled to the switch mechanism, the check valve additionally coupled to the manifold of the water distribution assembly.

14. The apparatus of claim 13, wherein the switch mechanism restricts water flow from the water reservoir to a flow rate of at least 0.4 and not substantially more than 0.75 pints per minute.

15. The apparatus of claim 13, wherein the check valve prevents back-flow from the water distribution assembly.

16. The apparatus of claim 13, wherein the water reservoir further comprises:

a hand pump.

17. The apparatus of claim 13, further comprising an extendable pole having a first end and a second end, the extendable pole comprising:

a handhold coupled to the first end;

a swivel mechanism coupled to the water distribution assembly at the second end; and the water flow control assembly.

18. The apparatus of claim 13, wherein water flows through the contact surface of the finishing pad at a surface flow rate of at least 0.022 pints per minute per square inch and not substantially more than 0.038 pints per minute per square inch.

* * * * *